US011311115B2

(12) United States Patent
Gao et al.

(10) Patent No.: US 11,311,115 B2
(45) Date of Patent: Apr. 26, 2022

(54) INFLATABLE BED

(71) Applicant: JIANGSU JILONG SPORT AND LEISURE PRODUCTS CO., LTD., Suqian (CN)

(72) Inventors: Lianping Gao, Suqian (CN); Jun You, Suqian (CN)

(73) Assignee: JIANGSU JILONG SPORT AND LEISURE PRODUCTS CO., LTD., Suqian (CN)

( * ) Notice: Subject to any disclaimer, the term of this patent is extended or adjusted under 35 U.S.C. 154(b) by 49 days.

(21) Appl. No.: 17/037,983

(22) Filed: Sep. 30, 2020

(65) Prior Publication Data

US 2021/0378412 A1 Dec. 9, 2021

(30) Foreign Application Priority Data

Jun. 8, 2020 (CN) ..... 202021036147.3

(51) Int. Cl.
*A47C 27/08* (2006.01)
*A47C 27/00* (2006.01)

(52) U.S. Cl.
CPC ..... *A47C 27/081* (2013.01); *A47C 27/087* (2013.01); *A47C 27/08* (2013.01)

(58) Field of Classification Search
CPC ..... A47C 27/08; A47C 27/081; A47C 27/082; A47C 27/087; A47C 27/10; A61G 7/05769; A61G 7/05776
USPC ..... 5/706, 710–713, 655.3, 654, 644
See application file for complete search history.

(56) References Cited

U.S. PATENT DOCUMENTS 5,727,266 A * 3/1998 Pang ..... A47G 9/0253 5/490
5,991,945 A * 11/1999 Pang ..... A47G 9/0253 5/490
6,568,012 B2 * 5/2003 Michaelis ..... A47C 27/10 5/413 AM
7,089,618 B1 * 8/2006 Metzger ..... A47C 27/081 5/709
7,353,555 B2 * 4/2008 Lau ..... A47C 27/081 5/706
8,516,632 B2 * 8/2013 Ogundare ..... A47G 9/0253 5/485
8,656,540 B2 * 2/2014 Chen ..... A47C 27/082 5/711
8,661,590 B2 * 3/2014 Chen ..... A47C 27/082 5/711
D747,117 S * 1/2016 Lau ..... D6/393
9,247,827 B2 * 2/2016 Lin ..... A47C 27/10
10,398,235 B2 * 9/2019 Lin ..... A47C 27/10
10,582,778 B2 * 3/2020 Ocegueda Gallaga ..... A47C 27/081

(Continued)

*Primary Examiner* — Robert G Santos

(57) ABSTRACT

The present disclosure provides an inflatable bed. The inflatable bed includes a tensioning assembly and an air valve, and further includes an upper piece, a bottom piece, a left piece, a right piece, a front piece, and a rear piece which cooperatively form an inflatable cavity. A left ring frame and a right ring frame are respectively provided on the left and right sides of the upper piece. The tensioning assembly is connected to the inner wall of the inflatable cavity. The air valve is communicated with the inflatable cavity. The inflatable bed of the present disclosure is simple in structure and more economical under the premise of preventing turning sideways.

10 Claims, 6 Drawing Sheets

(56) References Cited

U.S. PATENT DOCUMENTS 10,687,633 B2 * 6/2020 Liu ..... A47C 27/081
D913,014 S * 3/2021 Gao ..... D6/604
10,945,533 B1 * 3/2021 Shi ..... A47C 27/087
11,045,012 B2 * 6/2021 Ocegueda Gallaga ..... A47C 27/087
2003/0024049 A1 * 2/2003 Hsin ..... A47C 27/10 5/706
2003/0028972 A1 * 2/2003 Michaelis ..... A47C 17/86 5/710
2007/0124864 A1 * 6/2007 Lau ..... A47C 27/081 5/711
2008/0256717 A1 * 10/2008 Austen ..... A47C 19/022 5/709
2009/0165211 A1 * 7/2009 Song ..... A47C 27/087 5/706
2011/0265261 A1 * 11/2011 Ogundare ..... A47G 9/0253 5/485
2013/0145560 A1 * 6/2013 Chen ..... A47C 27/087 5/711
2013/0180052 A1 * 7/2013 Chen ..... A47C 27/087 5/711
2015/0201760 A1 * 7/2015 Lin ..... A47C 27/10 5/710
2016/0120331 A1 * 5/2016 Wang ..... A47C 27/082 5/694
2016/0183692 A1 * 6/2016 Lin ..... A47C 27/087 5/710
2017/0196368 A1 * 7/2017 Liu ..... A47C 27/16
2017/0215599 A2 * 8/2017 Lin ..... A47C 27/10
2018/0027985 A1 * 2/2018 Ocegueda Gallaga ..... A47C 27/081
2020/0205581 A1 * 7/2020 Ocegueda Gallaga ..... A47C 27/081
2020/0315366 A1 * 10/2020 Liu ..... A47C 27/087
2021/0127849 A1 * 5/2021 Li ..... A47C 27/087
2021/0196053 A1 * 7/2021 Li ..... A47C 27/087
2021/0378412 A1 * 12/2021 Gao ..... A47C 19/022

* cited by examiner

INFLATABLE BED

FIELD OF THE PRESENT DISCLOSURE

The present disclosure relates to the field of inflatable products, and more particularly to an inflatable bed.

DESCRIPTION OF RELATED ART

Inflatable bed refers to the bed that have excellent flexibility and elasticity, and expands in volume after being inflated. It has been widely used because of its portability and cost saving.

At present, inflatable beds on the market have various appearances, which can meet the different needs of consumers. However, the current inflatable bed always expands outwards after being inflated, especially when user lies on it, the side walls of the inflatable bed around are more likely to bulge. In order to solve the problem above, ring-shaped frame structures formed by drawstring are provided in the gasbags of the inflatable bed to tighten the gasbags. The inflatable bed having this structure can solve the problem of bulging, and at the same time achieve the effect of preventing the inflatable bed from turning sideways. However, the structure of this kind of inflatable bed is complicated and is not economical. In addition, the function of the current inflatable bed is relatively single, which cannot meet the needs of users better.

Therefore, it is desired to provide an inflatable bed which is simple in structure and more economical under the premise of preventing turning sideways.

SUMMARY OF THE PRESENT DISCLOSURE

The present disclosure is to provide an inflatable bed which is simple in structure and more economical under the premise of preventing left and right rollover.

For this purpose, the inflatable bed provided by the present disclosure includes:

an upper piece;

a bottom piece, the front side of the bottom piece is directly connected to the front side of the upper piece to form a front piece of the inflatable bed, and a rear piece is connected between the rear side of the bottom piece and the rear side of the upper piece;

a left piece, connecting with the bottom piece, the upper piece, the front piece, and the rear piece respectively;

a right piece, connecting with the bottom piece, the upper piece, the front piece, and the rear piece respectively, to cooperatively form an inflatable cavity;

a left ring frame including a left annular inner wall, one side of the left annular inner wall is connected with the periphery of the inner wall of the left piece and forms a first connecting line, and the other side of the left annular inner wall is connected with the inner wall of the bottom piece, the inner wall of the upper piece, the inner wall of the front piece, and the inner wall of the rear piece respectively and forms a second connecting line;

a right ring frame including a right annular inner wall, one side of the right annular inner wall is connected with the periphery of the inner wall of the right piece and forming a third connecting line, and the other side of the right annular inner wall is connected with the inner wall of the bottom piece, the inner wall of the upper piece, the inner wall of the front piece, and the inner wall of the rear piece respectively and forms a fourth connecting line;

a tensioning assembly connecting to the inner wall of the inflatable cavity; and an air valve communicated with the inflatable cavity.

Optionally, the side of the upper piece connecting the rear piece cooperates with the left piece, the right piece, and the rear piece to form a raised backrest, making the inflatable bed be L-shaped.

Optionally, the left annular inner wall, the left piece, the bottom piece, the upper piece, the front piece, and the rear piece cooperatively form a hollow ring structure, and the left annular inner wall is provided with a left through hole.

Optionally, the right annular inner wall cooperates with the right piece, the bottom piece, the upper piece, the front piece, and the rear piece to form a hollow ring structure, and a right through hole is defined in the right annular inner wall.

Optionally, the tensioning assembly includes at least one selected from a group consisting of horizontal pull strap, drilled pull strap, and vertical pull strap.

Optionally, the air valve communicated with the inflatable cavity is defined on the left piece or the right piece.

Optionally, the inflatable bed further includes an inflatable pillow.

Optionally, the inflatable bed further includes:

a pillow towel, the four corners of the pillow towel are respectively detachably connected to the four corners of one surface of the inflatable pillow by a connector.

Optionally, the connector is a sticky strap.

Optionally, the inflatable bed further includes an item hook arranged on the outer side wall of the left piece or the outer side wall of the right piece.

The inflatable bed of the present disclosure forms an inflatable cavity by means of the upper piece, the bottom piece, the front piece, the rear piece, the left piece, and the right piece, the front piece is formed by directly connecting the front side of the upper piece and the front side of the bottom piece, and the rear piece is connected between the rear side of the upper piece and the rear side of the bottom piece, thereby an extra ring frame structure being defined on the front side and the rear side of the upper piece to tighten the inflatable bed in the related art is avoided, thus greatly simplifies the structure of the inflatable bed. Further, the left side of the upper piece is defined with the left ring frame and the right side of the upper piece is defined with the right ring frame, one side of the left annular inner wall is connected with the periphery of the inner wall of the left piece and forms the first connecting line, and the other side of the left annular inner wall is connected with the inner wall of the bottom piece, the inner wall of the upper piece, the inner wall of the front piece, and the inner wall of the rear piece respectively and forms the second connecting line; one side of the right annular inner wall is connected with the periphery of the inner wall of the right piece and forms a third connecting line, and the other side of the right annular inner wall is connected with the inner wall of the bottom piece, the inner wall of the upper piece, the inner wall of the front piece, and the inner wall of the rear piece respectively and forms a fourth connecting line; then the left ring frame and the right ring frame play their roles to solve the problem of bulging at the left and right sides of the upper piece, which prevents the inflatable bed from turning sideways, making the structure of the inflatable bed be more simple and the inflatable bed be more economical.

Figure 1:
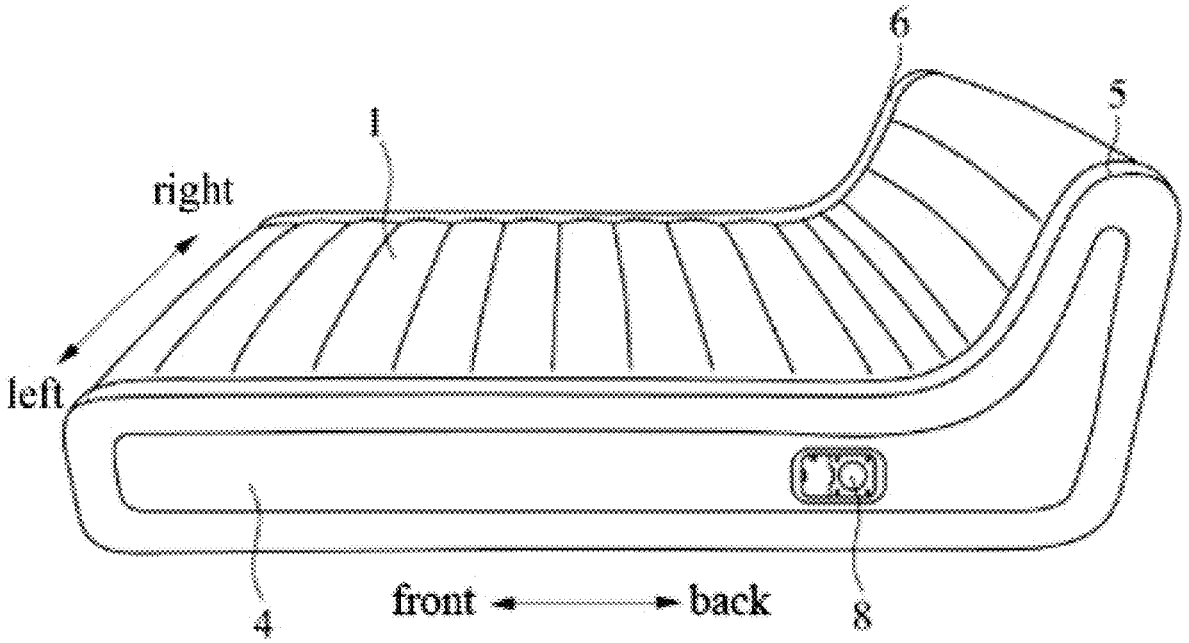
FIG. 1 is a side view of an inflatable bed in accordance with a first embodiment of the present disclosure.

1-upper piece; 2-bottom piece; 3-front piece; 4-left piece; 5-left ring frame; 51-left annular inner wall; 52-first connecting line; 53-second connecting line; 6-right ring frame; 7-tensioning assembly; 8-air valve; 9-inflatable pillow; 10-pillow towel; 11-connector; 12-item hook; 13-intubation tube; 14-supporting rod.

DETAILED DESCRIPTION OF THE EXEMPLARY EMBODIMENT

The technical solutions of the embodiments of the present disclosure will be clearly and completely described in the following with reference to the accompanying drawings. It is obvious that the embodiments to be described are only a part rather than all of the embodiments of the present disclosure.

In the description of the present disclosure, it should also be noted that, unless clearly specified and limited, otherwise the terms "connection" or "connect" should be understood in a broad sense, for example, it may be a fixing connection or a detachable connection, or an integral connection; it may also be a mechanical connection or an electrical connection; it may also be a direct connection, or an indirect connection through an intermediate medium, or a communication or interaction relationship between two elements. For those of ordinary skill in the art, the specific meanings of the above terms in the present disclosure can be understood according to the specific circumstance.

In the present disclosure, unless defined and limited expressly, otherwise the relationship terms "above" or "under" between a first feature and a second feature may include that the first and second features contact with each other directly, or the first and second features contact through other features located between them. Moreover, the relationship term "above", "up", or "upper" includes that the first feature is directly above or obliquely above the second feature, or it simply means that the horizontal height of the first feature is higher than that of the second feature. The relationship term "under" or "below" includes that the first feature is directly under or obliquely under the second feature, or it simply means that the horizontal height of the first feature is less than that of the second feature.

In the description of the present disclosure, it should be noted that the terms "up", "upper", "down", "below", "left", "right", "vertical", "horizontal", "inside", "inner", "outside", "outer" etc. indicate the location or the position relationship based on the drawings, or the location or position relationship of the product of the disclosure usually placed when being used. It is only for the convenience of describing the disclosure and simplifying the description, rather than indicating or implying that the device or the element must have a specific location, be constructed and operated in a specific orientation, and therefore cannot be understood as a limitation of the present disclosure. In addition, the terms "first", "second", "third", etc. are only used for distinguishing description, and cannot he understood as indicating or implying relative importance.

First Embodiment

Figure 2:
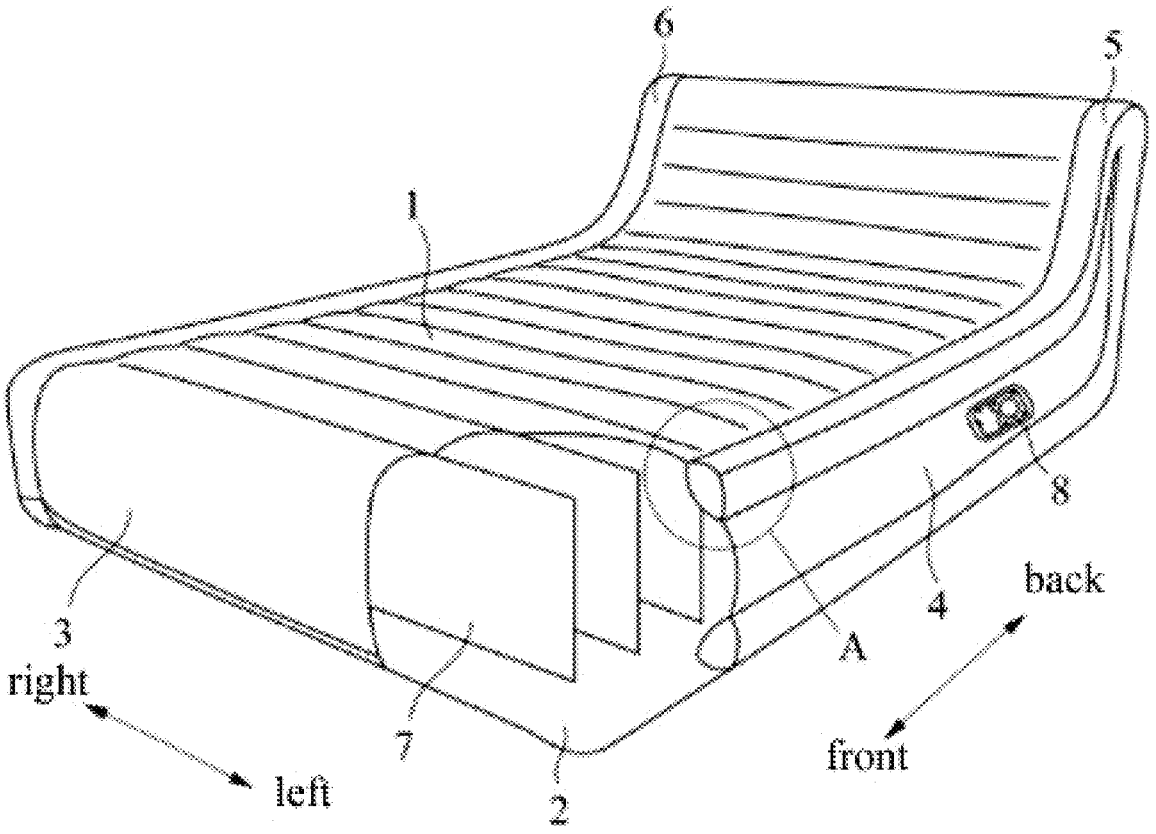
FIG. 2 is a structure diagram of the inflatable bed in accordance with the first embodiment of the present disclosure with a corner exploded.
Figure 3:
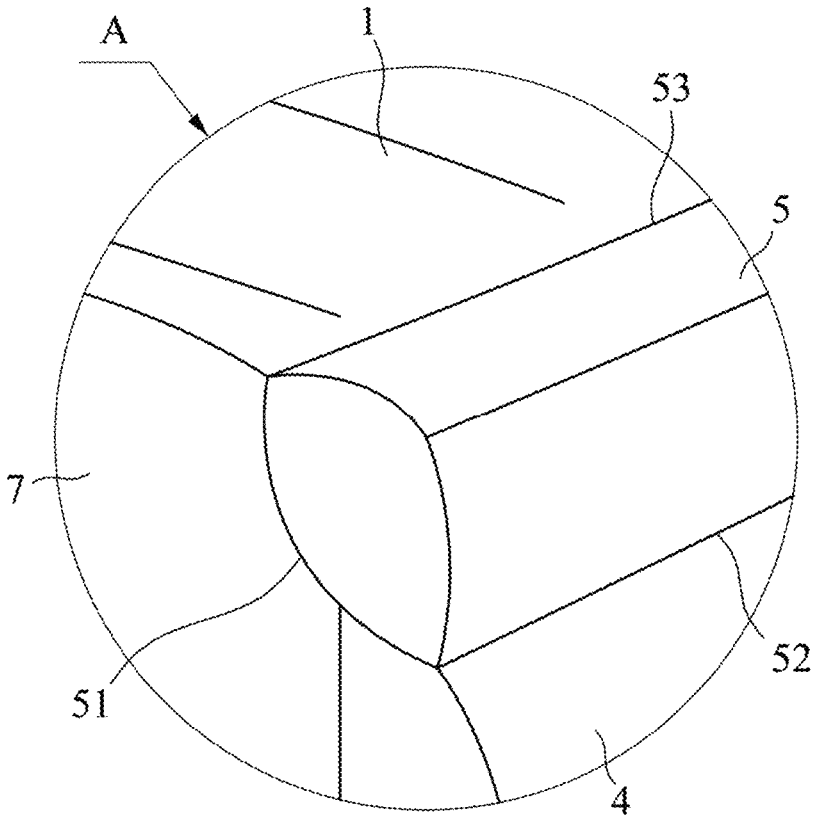
FIG. 3 is an enlarged view of portion A in FIG. 2.

Please referring to FIGS. 1 to 3, the exemplary embodiment provides an inflatable bed. The inflatable bed includes an upper piece 1, a bottom piece 2, a front piece 3, a rear piece (not shown in the figures), a left piece 4, a right piece (not shown in the figures), a left ring frame 5, a right ring frame 6, a tensioning assembly 7, and an air valve 8. The front side of the bottom piece 2 is directly connected to the front side of the upper piece 1, to form the front piece 3 of the inflatable bed. The rear side of the bottom piece 2 is connected to the rear side of the upper piece 1 by the rear piece, the rear piece may be a single piece, or a piece integrated with the upper piece 1, or a piece integrated with the bottom piece 2, and in the exemplary embodiment, the rear piece is a single piece. The left piece 4 is connected to the bottom piece 2, the upper piece 1, the front piece 3, and the rear piece respectively, and the right piece is connected to the bottom piece 2, the upper piece 1, the front piece 3, and the rear piece respectively, so as to cooperatively form a sealed inflatable cavity.

Please referring to FIGS. 2 to 3, the left ring frame 5 includes a left annular inner wall 51, one side of the left annular inner wall 51 is connected with the periphery of the inner wall of the left piece 4 and forms a first connecting line 52, and the other side of the left annular inner wall 51 is connected with the inner wall of the bottom piece 2, the inner wall of the upper piece 1, the inner wall of the front piece 3, and the inner wall of the rear piece respectively and forms a second connecting line 53. The right ring frame 6 includes a right annular inner wall (not shown in the figures), one side of the right annular inner wall is connected with the periphery of the inner wall of the right piece and forms a third connecting line (not shown in the figures), and the other side of the right annular inner wall is connected with the inner wall of the bottom piece 2, the inner wall of the upper piece 1, the inner wall of the front piece 3, and the inner wall of the rear piece respectively and forms a fourth connecting line (not shown in the figures). The tensioning assembly 7 is arranged in the inflatable cavity and connected to the inner wall of the inflatable cavity, and the air valve 8 is communicated with the inflatable cavity for inflating or deflating the inflatable bed.

The left ring frame 5 and the right ring frame 6 are configured to solve the problem of bulging on the left and right sides of the inflatable bed, to prevent the inflatable bed from turning sideways. Specifically, please referring to FIG. 2, in the exemplary embodiment, the left annular inner wall 51, the left piece 4, the bottom piece 2, the upper piece 1, the front piece 3, and the rear piece cooperatively form a hollow ring structure of the left ring frame 5. At the same time, the left annular inner wall 51 is provided with a left through hole to allow air to be inflated into the hollow ring structure. Please further referring to FIGS. 2 to 3, one side of the left annular inner wall 51 is connected with the periphery of the inner wall of the left piece 4 and forms the first connecting line 52, and the other side of the left annular inner wall 51 is connected with the inner wall of the bottom piece 2, the inner wall of the upper piece 1, the inner wall of the front piece 3, and the inner wall of the rear piece respectively and forms the second connecting line 53. When inflation of the inflatable bed is completed, the inflatable bed bulges, then the left annular inner wall 51 plays the role of synchronously tensioning the upper piece 1, the bottom piece 2, the front piece 3, the rear piece, and the left piece 4. Due to the left annular inner wall 51 having a left through hole, the inner cavity of the hollow ring structure is also filled with air and bulged to form a swollen left ring frame 5. Similarly, in the exemplary embodiment, the right annular inner wall cooperates with the right piece, the bottom piece 2, the upper piece 1, the front piece 3, and the rear piece to form a hollow ring structure, and a right through hole (not shown in the figures) is defined in the right annular inner wall. When the inflation is completed, the inflatable bed bulges, then the right annular inner wall also plays the role of synchronously tightening the upper piece 1, the bottom piece 2, the front piece 3, the rear piece, and the right piece. Due to the right annular inner wall being defined with the right through hole, the inner cavity of the hollow ring structure of the right ring frame 6 will also be filled with air and bulged. Since the structure of the right ring frame 6 is the same as the structure of the left ring frame 5, its specific structure is not described in detail with the drawings.

The inflatable bed of the exemplary embodiment forms an inflatable cavity by means of the upper piece 1, the bottom piece 2, the front piece 3, the rear piece, the left piece 4, and the right piece, the front piece 3 is formed by directly connecting the front side of the upper piece 1 add the front side of the bottom piece 2, and the rear piece is connected between the rear side of the upper piece 1 and the rear side of the bottom piece 2, thereby an extra ring frame structure being defined on the front side and the rear side of the upper piece 1 to tighten the inflatable bed in the related art is avoided, thus greatly simplifies the structure of the inflatable bed. Further, the left side of the upper piece 1 is defined with the left ring frame 5 and the right side of the upper piece 1 is defined with the right ring frame 6, one side of the left annular inner wall 51 is connected with the periphery of the inner wall of the left piece 4 and forms the first connecting line 52, and the other side of the left annular inner wall 51 is connected with the inner wall of the bottom piece 2, the inner wall of the upper piece 1, the inner wall of the front piece 3, and the inner wall of the rear piece respectively and forms the second connecting line 53; one side of the right annular inner wall is connected with the periphery of the inner wall of the right piece and forms a third connecting line, and the other side of the right annular inner wall is connected with the inner wall of the bottom piece 2, the inner wall of the upper piece 1, the inner wall of the front piece 3, and the inner wall of the rear piece respectively and forms a fourth connecting line; then the left ring frame 5 and the right ring frame 6 play their roles to solve the problem of bulging at the left and right sides of the upper piece to prevent the upper piece 1 from forming a rounded surface. At the same time, the left ring frame 5 and the right ring frame 6 respectively form a tightening ring structure, which prevents the inflatable bed from turning sideways. Compared to the related art, the exemplary embodiment no longer needs to provide a front ring frame and a rear ring frame of the inflatable bed, since the front piece 3 is formed by directly connecting the front side of the upper piece 1 and the front side of the bottom piece 2, making the structure of the inflatable bed be more simple and the inflatable bed be more economical.

Further, please referring to FIGS. 1 to 2, the side of the upper piece 1 connecting the rear piece cooperates with the left piece 4, the right piece, and the rear piece to form a raised backrest (not marked in the figure) making the inflatable bed be L-shaped. The raised backrest is configured for users to lean on. Meanwhile, in the exemplary embodiment, the raised backrest is located at the rear side of the inflatable bed, and the rear side of the upper piece 1 forms the upper surface of the raised backrest, so the whole structure is integrated and simple. Further, the upper surface of the raised backrest is a curved surface, which may provide users more comfortable leaning experience.

In addition, in the exemplary embodiment, the tensioning assembly 7 is arranged in the inflatable cavity and is configured to tension the inner wall of the inflatable cavity, thereby the inflatable bed would not be inflated to be a spherical structure. The tensioning assembly 7 may include horizontal pull straps, drilled pull straps, or vertical pull straps, or a combination of the two or three kinds of the pull straps. Specifically, as shown in FIG. 2, in the exemplary embodiment, the tensioning assembly 7 includes a plurality of horizontal pull straps arranged in the inflatable cavity at intervals along the direction of front and back. Each the horizontal pull strap extends along the direction of left and right, the upper end of the horizontal pull strap is connected with the inner wall of the upper piece 1, and the bottom end of the horizontal pull strap is connected with the inner wall of the bottom piece 2, so as to tighten the upper piece 1 and the bottom piece 2, allowing the inflatable bed to form the shape of the bed.

In order to inflate the inflatable cavity, as shown in FIG. 2, the air valve 8 which is communicated with the inflatable cavity is defined on the left piece 4. On one hand, it is convenient for users to find the air valve 8 for inflating; on the other hand, the installation position of the air valve 8 would not affect the normal use of the inflatable bed.

Second Embodiment

Figure 4:
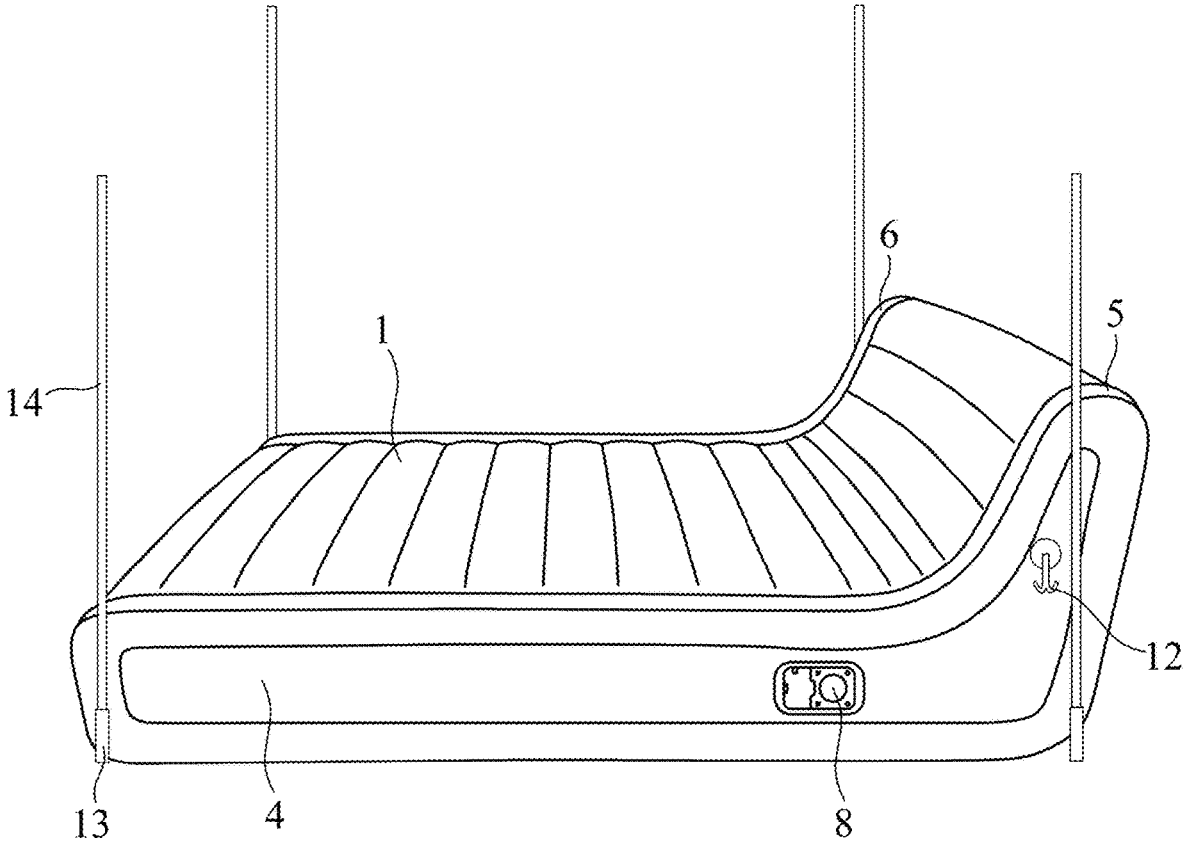
FIG. 4 is a side view of an inflatable bed in accordance with a second embodiment of the present disclosure.

The exemplary embodiment is an improvement of the inflatable bed provided in the first embodiment. The inflatable bed in the exemplary embodiment includes all the characteristics of the inflatable bed provided in the first embodiment. Please referring to FIG. 4, the inflatable bed in the exemplary embodiment further includes an item hook 12, and the item hook 12 is arranged on the outer side wall of the left piece 4. In other embodiments, the outer side wall of the right piece may also be provided with the item hook 12. Users can hang bags, glasses, and other articles on the item hook 12, which meets the user's need of placing some small items.

In addition, in summer, users may be prone to be bit by mosquitoes when using the inflatable bed without tents, especially in outdoors, which makes users fall asleep hardly. Please referring to FIG. 4, in the exemplary embodiment, the side walls at the four corners of the inflatable bed are respectively provided with an intubation tube 13, and each intubation tube 13 is inserted with a supporting rod 14, thereby forms a supporting frame for supporting bed nets. Users can directly put the bed net on the supporting frame to avoid mosquito bites.

Figure 5:
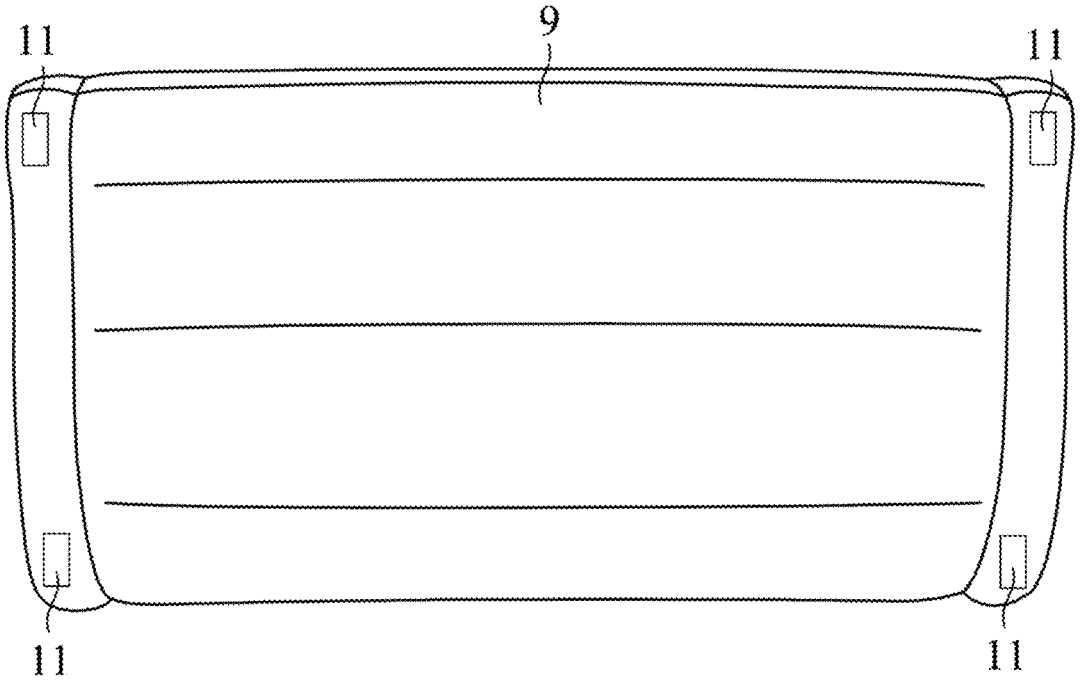
FIG. 5 is a structure diagram of an inflatable pillow in accordance with the second embodiment of the present disclosure.

Further, as shown in FIG. 5, in the exemplary embodiment, the inflatable bed also includes an inflatable pillow 9. The inflatable pillow 9 is nearly a cuboid airbag structure having an inflatable nozzle formed thereon. The inflatable pillow 9 can be directly inflated when in use, and deflated when not in use and to be compressed and stored, which is portable and space saved.

Figure 6:
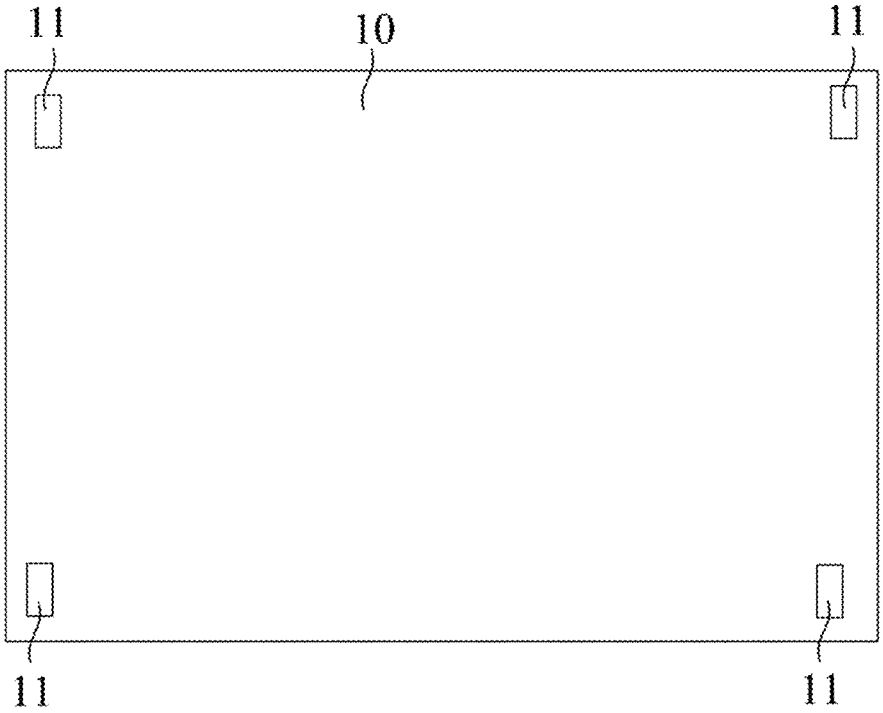
FIG. 6 is a schematic diagram of a pillow towel in accordance with the second embodiment of the present disclosure.

Further, in order to keep clean, in the exemplary embodiment, as shown in FIG. 6, the inflatable bed also includes a pillow towel 10. The four corners of the pillow towel 10 are respectively detachably connected to the four corners of one surface of the inflatable pillow 9 by a connector 11, so that the pillow towel 10 can be firmly fixed on the surface of the inflatable pillow 9. Specifically, please referring to FIGS. 5 to 6, the connector 11 in the exemplary embodiment is a sticky strap, namely hook and loop fastener. The sticky strap includes a sub piece and a master piece, the upper surface of the sub piece is covered with loops, and the upper surface of the master piece is covered with small hooks. The sub piece is fixed on the surface of the inflatable pillow 9, and the master piece is fixed on the pillow towel 10. The structure of the connector 11 is simple, and the sub and master pieces of the connector 11 are easy to be bonded and disassembled.

Third Embodiment

Figure 7:
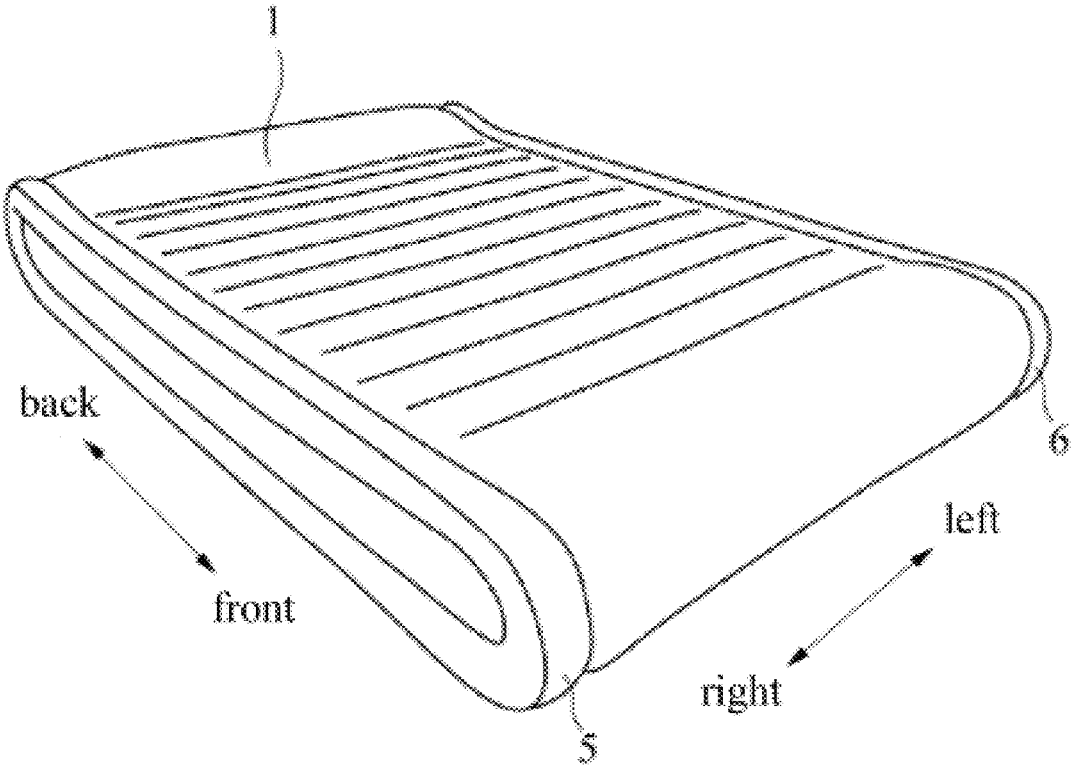
FIG. 7 is a perspective view of an inflatable bed in accordance with a third embodiment of the present disclosure.

Please referring to FIG. 7, the exemplary embodiment provides an inflatable bed. The upper piece 1 of the inflatable bed is also defined with a left ring frame 5 and a right ring frame 6 at the left side and the right side respectively. The difference between the exemplary embodiment and the first embodiment is that the inflatable bed in the exemplary embodiment does not have a raised backrest, and the upper piece 1 and the rear piece is an integrated structure. The structure of the inflatable bed in the exemplary embodiment is more simple and economical.

Obviously, the foregoing embodiments of the present disclosure are merely examples for the purpose of clearly illustrating the present disclosure, and are not intended to limit the present disclosure. For those of ordinary skill in the art, changes can be made on the basis of the above description. Any modification, equivalent replacement and improvement made within the spirit and principle of the present disclosure shall fall in the protection scope of the disclosure.

What is claimed is:

1. An inflatable bed, comprising:

an upper piece (1);

a bottom piece (2), the front side of the bottom piece (2) being directly connected to the front side of the upper piece (1) to form a front piece (3) of the inflatable bed, and a rear piece being connected between the rear side of the bottom piece (2) and the rear side of the upper piece (1);

a left piece (4), connecting with the bottom piece (2), the upper piece (1), the front piece (3), and the rear piece respectively;

a right piece, connecting with the bottom piece (2), the upper piece (1), the front piece (3), and the rear piece respectively, to cooperatively form an inflatable cavity;

a left ring frame (5), comprising a left annular inner wall (51), one side of the left annular inner wall (51) being connected with the periphery of the inner wall of the left piece (4) and forming a first connecting line (52), and the other side of the left annular inner wall (51) being connected with the inner wall of the bottom piece (2), the inner wall of the upper piece (1), the inner wall of the front piece (3), and the inner wall of the rear piece respectively and forming a second connecting line (53);

a right ring frame (6), comprising a right annular inner wall, one side of the right annular inner wall being connected with the periphery of the inner wall of the right piece and forming a third connecting line, and the other side of the right annular inner wall being connected with the inner wall of the bottom piece (2), the inner wall of the upper piece (1), the inner wall of the front piece (3), and the inner wall of the rear piece respectively and forming a fourth connecting line;

a tensioning assembly (7), connecting to the inner wall of the inflatable cavity; and an air valve (8), being communicated with the inflatable cavity.

2. The inflatable bed according to claim 1, wherein the side of the upper piece (1) connecting the rear piece cooperates with the left piece (4), the right piece, and the rear piece to form a raised backrest, making the inflatable bed be L-shaped.

3. The inflatable bed according to 1, wherein the left annular inner wall (51), the left piece (4), the bottom piece (2), the upper piece (1), the front piece (3), and the rear piece cooperatively form a hollow ring structure, and the left annular inner wall (51) is provided with a left through hole.

4. The inflatable bed according to claim 1, wherein the right annular inner wall cooperates with the right piece, the bottom piece (2), the upper piece (1), the front piece (3), and the rear piece to form a hollow ring structure, and a right through hole is defined in the right annular inner wall.

5. The inflatable bed according to claim , wherein the tensioning assembly (7) comprises at least one selected from a group consisting of horizontal pull strap, drilled pull strap, and vertical pull strap.

6. The inflatable bed according to claim 1, wherein the air valve (8) communicated with the inflatable cavity is defined on the left piece (4) or the right piece.

7. The inflatable bed according to claim 1, further comprising an inflatable pillow (9).

8. The inflatable bed according to claim 7, wherein the inflatable bed further comprises a pillow towel (10), the four corners of the pillow towel (10) are respectively detachably connected to the four corners of one surface of the inflatable pillow (9) by a connector (11).

9. The inflatable bed according to claim 8, wherein the connector (11) is a sticky strap.

10. The inflatable bed according to claim 1, further comprising an item hook (12) arranged on the outer side wall of the left piece (4) or the outer side wall of the right piece.

* * * * *